United States Patent [19]

Smiley

[11] 4,016,888

[45] Apr. 12, 1977

[54] ADJUSTABLE WIGS

[75] Inventor: Alan Michael Smiley, North Miami, Fla.

[73] Assignee: Revlon, Inc., New York, N.Y.

[22] Filed: Feb. 18, 1976

[21] Appl. No.: 659,133

[52] U.S. Cl. ..... 132/53
[51] Int. Cl.[2] ..... A41G 3/00
[58] Field of Search ..... 132/53, 54, 9

[56] References Cited

UNITED STATES PATENTS

| | | | |
|---|---|---|---|
| 1,490,479 | 4/1924 | Noel | 132/53 |
| 3,654,938 | 4/1972 | Spangler et al. | 132/53 |
| 3,889,414 | 6/1975 | Whetzel | 132/53 |

*Primary Examiner*—G.E. McNeill
*Attorney, Agent, or Firm*—Leon E. Tenenbaum

[57] ABSTRACT

Three sets of fastening means are attached to the inside of a wig cap. By connecting these fastening means the size and shape of the wig are adjustable as desired.

5 Claims, 3 Drawing Figures

FIG. 1
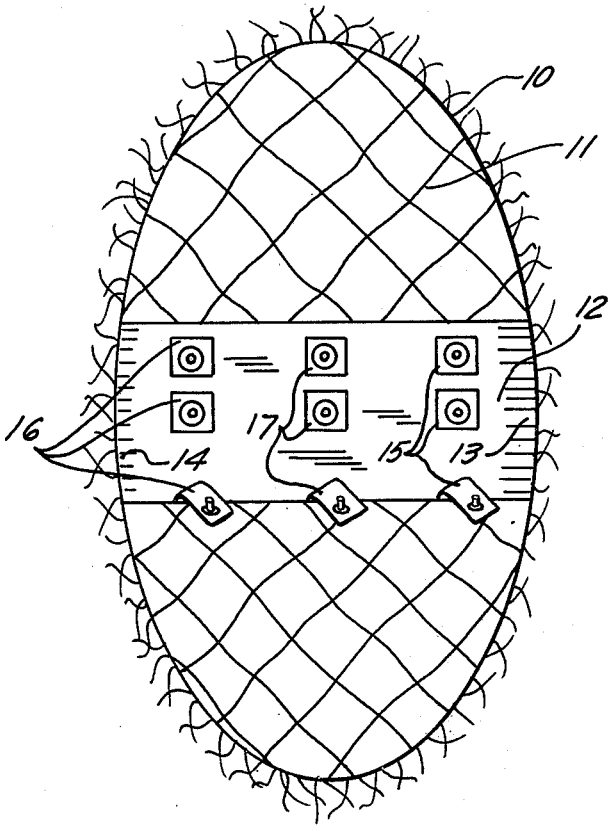
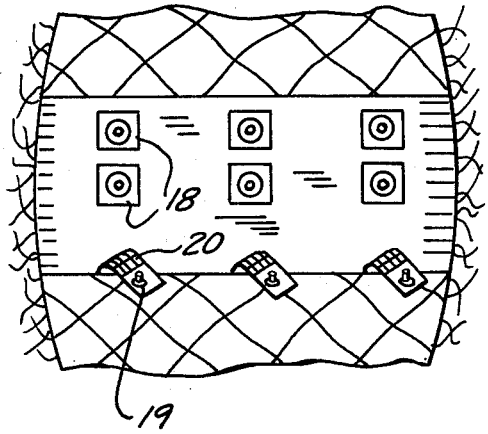
FIG. 2
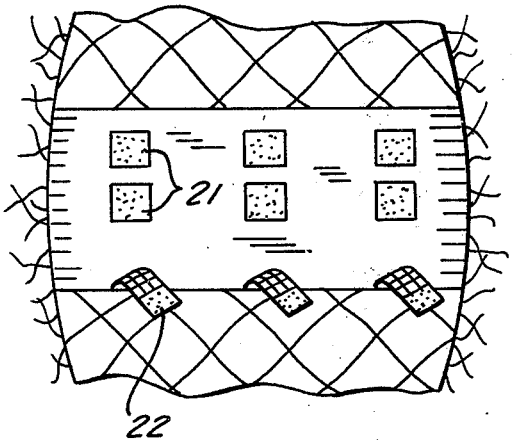
FIG. 3

ADJUSTABLE WIGS

This invention relates to wigs. It particularly relates to wig caps having means for reducing the headsize of the caps.

Wigs, as presently constructed, are provided in three basic sizes: regular, petite and extra-petite. At first, wigs were made in a single size, the regular. These wigs were, and still are, provided with caps having stretch fabric foundations. These stretch foundations were believed to provide sufficient adjustability of the cap so that there would be a proper and comfortable fit. However, the stretch foundations did not provide a proper fit for women having smaller heads or less than the normal amount of hair or thinner hair. To meet this problem, two smaller sizes, petite and extra-petite were created. Even with the availability of three different wig sizes, there were still problems in achieving a proper and comfortable fit.

To meet this problem means were provided for further reducing or adjusting the size of the wig cap. A commonly used means is a set of fastener bands attached in linear relationship to the stretch foundation, as described in U.S. Pat. No. 3,884,248. However, these means controlled the size of the wig in one plane usually around the circumference of the lower portion of the wig, and while they might provide a secure and comfortable fit at the lower portion of the wig, the remainder of the wig might still be too bulky for the wearer and not give a proper and comfortable fit at the top of the head. This was particularly so when a woman used a wig which, to begin with, was too big for her head; i.e. if she used a regular when she needed a petite or used a petite when she needed an extra-petite. Furthermore, since such wig had been reduced in size at only its lower portion, the remainder of the wig, in addition to not fitting properly, had the same appearance as before reduction in size; i.e. the wig appeared bulky and ill-fitting.

While wigs of the three different sizes are available, it is burdensome for the retailer to carry wigs of these different sizes, and it would be preferable to market wigs in a single size that could be readily reduced and adjusted as desired by the user to provide a proper fit in three dimensions.

It is, accordingly, an object of the present invention to provide means for reducing the headsize of wig caps.

It is another object of the present invention to provide means for reducing the headsize of wig caps in three dimensions.

It is a further object of the present invention to provide means for reducing the headsize of wig caps, which means are easily secured to the wig cap and are not exposed when used.

It is still another object of the present invention to provide means for reducing the headsize of wig caps so that the wigs so reduced in size will not only fit properly but have a proper appearance.

These and other objects of the present invention may be readily ascertained by referring to the following description and appended illustrations in which:

FIG. 1 is a view of the inside of a wig cap (turned inside out) showing the fastening means in place.

FIG. 2 is a view showing the fastening means in greater detail.

FIG. 3 is the same as FIG. 2 but showing different fastening means.

Referring now to the drawings, the stretch foundation 10 of the wig comprises a nylon mesh 11 and a netting crown 12 stretching from side 13 to side 14 across the crown substantially in the center of the cap. To the netting crown are attached three sets of closures 15, 16 and 17, two 15 and 16 at the side of the cap and one 17 in the center. As shown in FIG. 2 which illustrates snap fasteners, each set of closures comprises two fixed fasteners 18 and one movable fastener 19 attached to a strip 20, one fixed fastener, the outer fixed fastener, being positioned near one edge of the netting crown, the strip to which the movable fastener is attached being positioned near the opposite edge of the netting crown, and the second fixed fastener, the inner fixed fastener, being positioned substantially in the middle of the netting crown in the substantial linear relationship to the first fixed fastener and the movable fastener. In the illustration, the fixed snap fasteners are female and the movable snap fastener is male, but, if desired, the fixed fasteners may be male and the movable female.

Instead of the snap type fastener other fasteners such as hook (male) and eye (female) and woven tape fasteners in which the two fixed fasteners 21 (female) have soft loops and the movable fasteners 22 (male) have stiff hooks.

If the wig is of a size with which the wearer is comfortable the closures are left unfastened. If changes in size are desired, the closures are snapped shut to give the desired size. If, for example, it is desired to convert a regular size wig to a petite the movable fasteners are joined to the inner fixed fasteners, and if it desired to further reduce the size of the cap, say to an extra-petite, the movable fasteners are joined to the outer fixed fasteners. Depending upon the size and shape of the head the different closures can be adjusted as desired so that not all are the same. For example, if the user has a high crown, she may wish to leave the middle closure open while closing the side ones.

The reduction in the size of the wig not only provides a reduction in the size of the wig cap but also effects a reduction in the outside portion of the wig, so that the wig not only feels smaller, as desired, but also looks smaller. This results from the compression of one set of curls on the wig into another set. Thus, when a regular wig is reduced to a petite or extra-petite the reduced wig will not only have the smaller fit of the petite or extra-petite but will also look like a petite or extra-petite wig.

I claim:

1. Means for reducing the size of a wig cap in combination with a stretch foundation fitting the head, said stretch foundation comprising a nylon mesh and a netting crown which stretches from side to side across the crown of the user's head, said means comprising three sets of closures, each set consisting of two fixed fasteners and one movable fastener, one fixed fastener being positioned near one edge of the netting crown, the movable fastener being attached to a strip which is attached at the opposite edge of the netting crown, and the second fixed fastener being positioned substantially in the middle of the netting crown in substantial linear relationship to the first fixed fastener and the movable fastener, one of said sets of closures being positioned on one side of the foundation, the second at the other side, and the third in the middle.

2. The means according to claim 1, wherein the fixed fasteners are female fasteners and the movable fastener is a male fastener.

3. The means according to claim 1, wherein the fixed fasteners are male fasteners and the movable fastener is a female fasteners.

4. The means according to claim 1, wherein the closures consist of snap fasteners.

5. The means according to claim 2, wherein the fixed fasteners are female snap fasteners and the movable fastener is a male snap fastener.

* * * * *